US012673357B2

(12) United States Patent
Tanaka

(10) Patent No.: US 12,673,357 B2
(45) Date of Patent: Jul. 7, 2026

(54) METHOD OF MANUFACTURING VEHICLE PILLAR AND PRESS FORMING DIE

(71) Applicant: TOPRE CORPORATION, Tokyo (JP)

(72) Inventor: Ayano Tanaka, Sagamihara (JP)

(73) Assignee: TOPRE CORPORATION, Tokyo (JP)

( * ) Notice: Subject to any disclaimer, the term of this patent is extended or adjusted under 35 U.S.C. 154(b) by 0 days.

(21) Appl. No.: 19/287,914

(22) Filed: Aug. 1, 2025

(65) Prior Publication Data

US 2026/0042137 A1 Feb. 12, 2026

(30) Foreign Application Priority Data

Aug. 8, 2024 (JP) ..... 2024-131752

(51) Int. Cl.

| | |
|---|---|
| ***B21D 47/01*** | (2006.01) |
| ***B21D 22/22*** | (2006.01) |
| ***B21D 22/26*** | (2006.01) |
| ***B21D 35/00*** | (2006.01) |
| ***B21D 53/88*** | (2006.01) |

(52) U.S. Cl.

CPC ..... *B21D 53/88* (2013.01); *B21D 22/22* (2013.01); *B21D 22/26* (2013.01); *B21D 35/001* (2013.01); *B21D 47/01* (2013.01)

(58) Field of Classification Search

CPC ..... B21D 22/30; B21D 53/88; B21D 22/22; B21D 22/26; B21D 35/001; B21D 47/01; B21D 24/12; C21D 8/0294

See application file for complete search history.

(56) References Cited

U.S. PATENT DOCUMENTS

| | | | | |
|---|---|---|---|---|
| 9,839,954 | B2 * | 12/2017 | Miyagi | B21D 22/30 |
| 2015/0273563 | A1 | 10/2015 | Miyagi et al. | |
| 2021/0178446 | A1 * | 6/2021 | Oooka | B21D 24/12 |
| 2023/0117515 | A1 * | 4/2023 | Molina Mesa | C21D 8/0294 148/639 |

FOREIGN PATENT DOCUMENTS

WO 2014/050973 A1 4/2014

* cited by examiner

*Primary Examiner* — Lee A Holly

(74) *Attorney, Agent, or Firm* — METROLEX IP LAW GROUP, PLLC; Robert L. Scott, Esq.

(57) ABSTRACT

A method of manufacturing a vehicle pillar includes: a blanking for obtaining a work piece by cutting a material; a drawing for obtaining an intermediate product by forming the work piece, using an upper die and a lower die; and a trimming for removing an unnecessary portion of the intermediate product. In the drawing, both ends of the work piece in a longer side direction are clamped between pressing pads and a punch. Then, in the drawing, both ends of the work piece in a shorter side direction are clamped between blank holders and a die. In the drawing, a center portion of the work piece is clamped between the die and the punch to form the work piece, while the clamping performed by the pressing pads and the punch, and the clamping performed by the blank holders and the die are maintained.

3 Claims, 5 Drawing Sheets

METHOD OF MANUFACTURING VEHICLE PILLAR AND PRESS FORMING DIE

CROSS-REFERENCE TO RELATED APPLICATIONS

The present application is based on, and claims priority from the prior Japanese Patent Application No. 2024-131752, filed on Aug. 8, 2024, the entire contents of which are incorporated herein by reference.

TECHNICAL FIELD

The present disclosure relates to a method of manufacturing a vehicle pillar and a press forming die.

BACKGROUND

High strength is required for a vehicle body of an automobile, and as a material, a high tensile strength steel sheet (high tensile strength steel) is used. In recent years, even higher strength is required, and therefore, as a material, an ultra high tensile strength steel is also used. The high tensile strength steel and the ultra high tensile strength steel have excellent deformation strength and fracture strength, but have low ductility. Therefore, it is known that it is difficult to perform press forming such as deep drawing.

A center pillar includes a upper pillar portion which is coupled to a roof rail, when the center pillar is assembled to a vehicle body, a lower pillar portion which is coupled to a side sill, when the center pillar is assembled to the vehicle body, and a center pillar portion which connects the upper pillar portion and the lower pillar portion, and extends in a height direction of the vehicle body, for example. Each of the upper pillar portion and the lower pillar portion is formed in an approximately T-shape. The center pillar portion connecting the upper pillar portion and the lower pillar portion is formed in a hat shape, which includes a center top plate portion, a pair of vertical wall portions connected to the center top plate portion, and flange portions connected to the pair of vertical wall portions, respectively.

WO 2014/050973 discloses a die used for performing deep drawing in a process of press forming a center pillar. The die includes a die of an upper die, a blank holder, and a punch of a lower die. In order to perform deep drawing, the die is attached to a press machine, a material is set at a predetermined position, and the press machine is operated. First, the material is clamped between the die of the upper die and the blank holder. Next, while the material is clamped between the die of the upper die and the blank holder, the punch of the lower die is pushed into a central part of the material to form a center pillar with a hat shaped basic cross section.

SUMMARY OF THE INVENTION

In a conventional process of press forming a general center pillar, press forming is performed by clamping the whole periphery of a material using a blank holder. Therefore, in a post-process, many of the clamped portions are trimmed (cut) and removed. In particular, an upper pillar portion and a lower pillar portion of the center pillar constitute ends of the center pillar in a longer side direction. Therefore, the yield may deteriorate by cutting and removing many of the ends in the longer side direction.

An object of the present disclosure is to provide a method of manufacturing a vehicle pillar and a press forming die which can enhance the yield.

A method of manufacturing a vehicle pillar according to an embodiment is a method of manufacturing a vehicle pillar including: an upper pillar portion that is coupled to a roof rail, when the vehicle pillar is assembled to a vehicle body; a lower pillar portion that is coupled to a side sill, when the vehicle pillar is assembled to the vehicle body; and a center pillar portion that connects the upper pillar portion and the lower pillar portion, and extends in a height direction of the vehicle body. The manufacturing method includes: a blanking for obtaining a work piece by cutting a material; a drawing for obtaining an intermediate product by forming the work piece, using an upper die that includes a die and a pair of pressing pads, and a lower die that includes a punch and a pair of blank holders; and a trimming for removing an unnecessary portion of the intermediate product. In the drawing, both ends of the work piece in a longer side direction are clamped between the pressing pads and the punch, then, both ends of the work piece in a shorter side direction are clamped between the blank holders and the die, and a center portion of the work piece is clamped between the die and the punch to form the work piece, while the clamping performed by the pressing pads and the punch, and the clamping performed by the blank holders and the die are maintained.

A press forming die according to an embodiment is a press forming die that is used to press form a work piece, and is used for manufacturing a vehicle pillar including: an upper pillar portion that is coupled to a roof rail, when the vehicle pillar is assembled to a vehicle body; a lower pillar portion that is coupled to a side sill, when the vehicle pillar is assembled to the vehicle body; and a center pillar portion that connects the upper pillar portion and the lower pillar portion, and extends in a height direction of the vehicle body. The press forming die includes: an upper die that includes a die and a pair of pressing pads; and a lower die that includes a punch and a pair of blank holders. The upper die and the lower die are configured such that both ends of the work piece in a longer side direction are clamped between the pressing pads and the punch, before a center portion of the work piece is clamped between the die and the punch to form the work piece.

According to the above configuration, it is possible to provide a method of manufacturing a vehicle pillar and a press forming die which can enhance the yield.

DETAILED DESCRIPTION OF THE INVENTION

Figure 1:
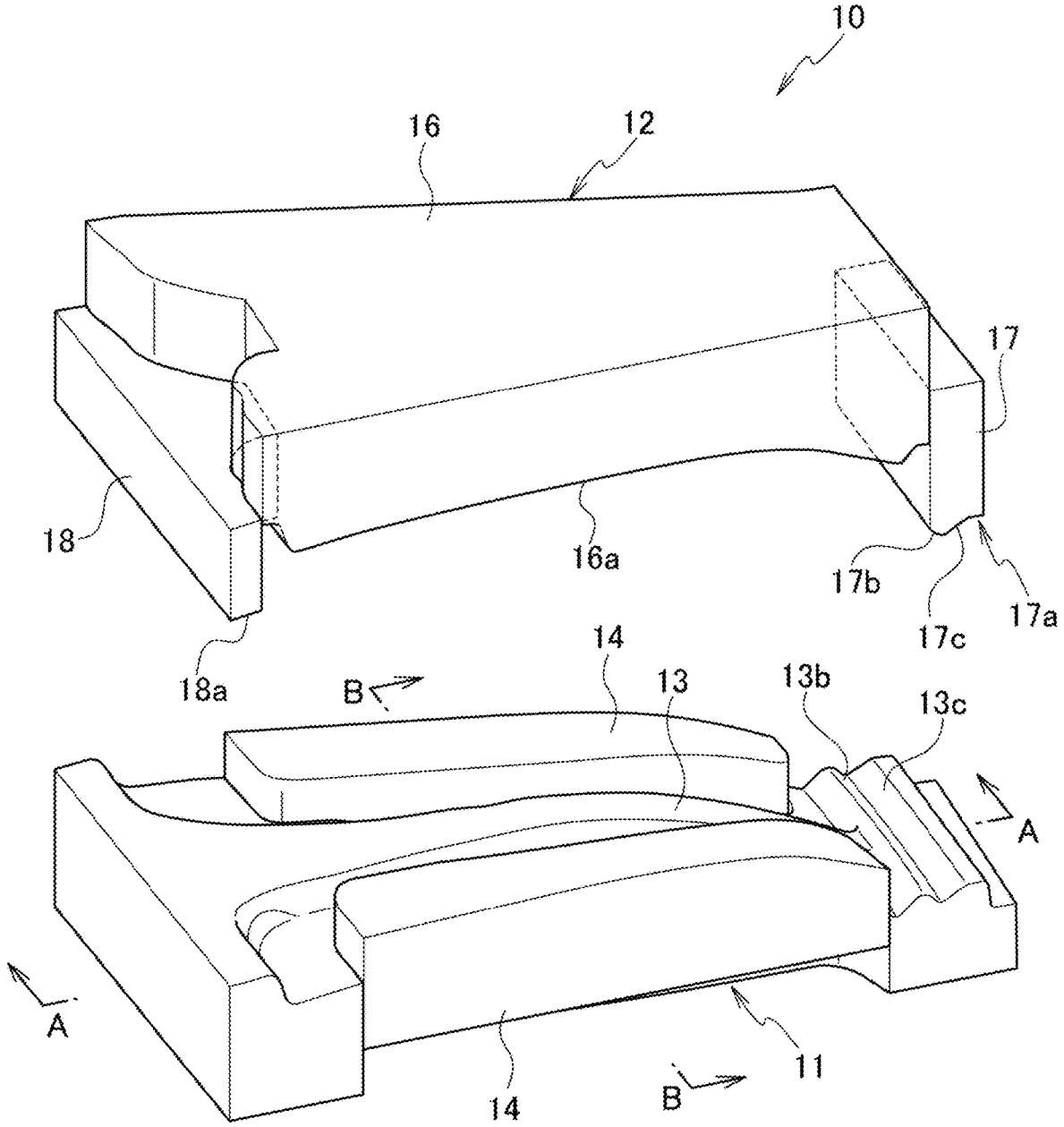
FIG. 1 is a schematic perspective view illustrating a press forming die according to the present embodiment.
Figure 2:
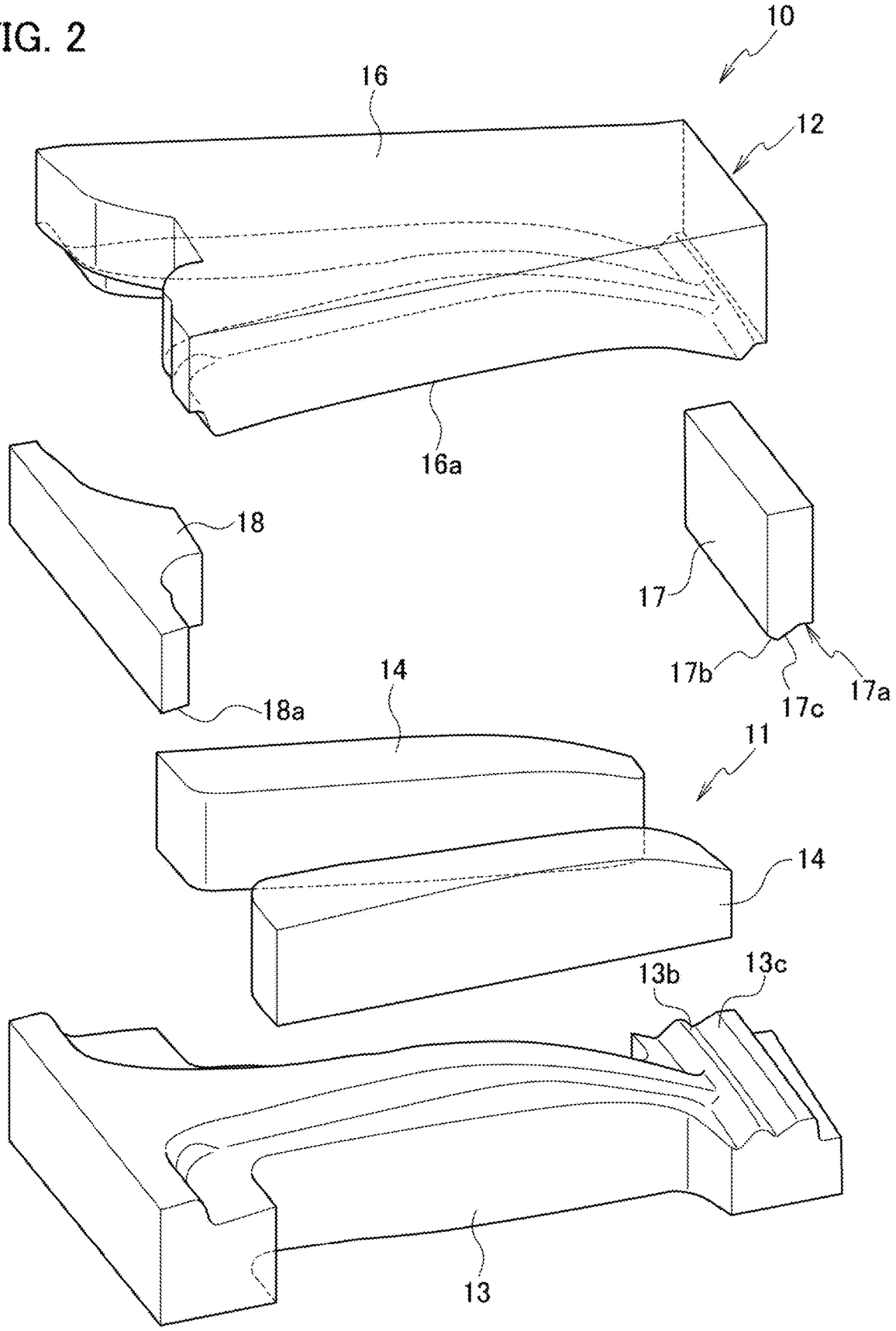
FIG. 2 is a schematic perspective view illustrating an exploded press forming die according to the present embodiment.

Using the drawings, a detailed description is given below of a vehicle pillar according to the present embodiment. Note that dimensional ratios in the drawings are exaggerated for convenience of explanation and are sometimes different from actual ratios.

[Vehicle Pillar]

Figure 5:
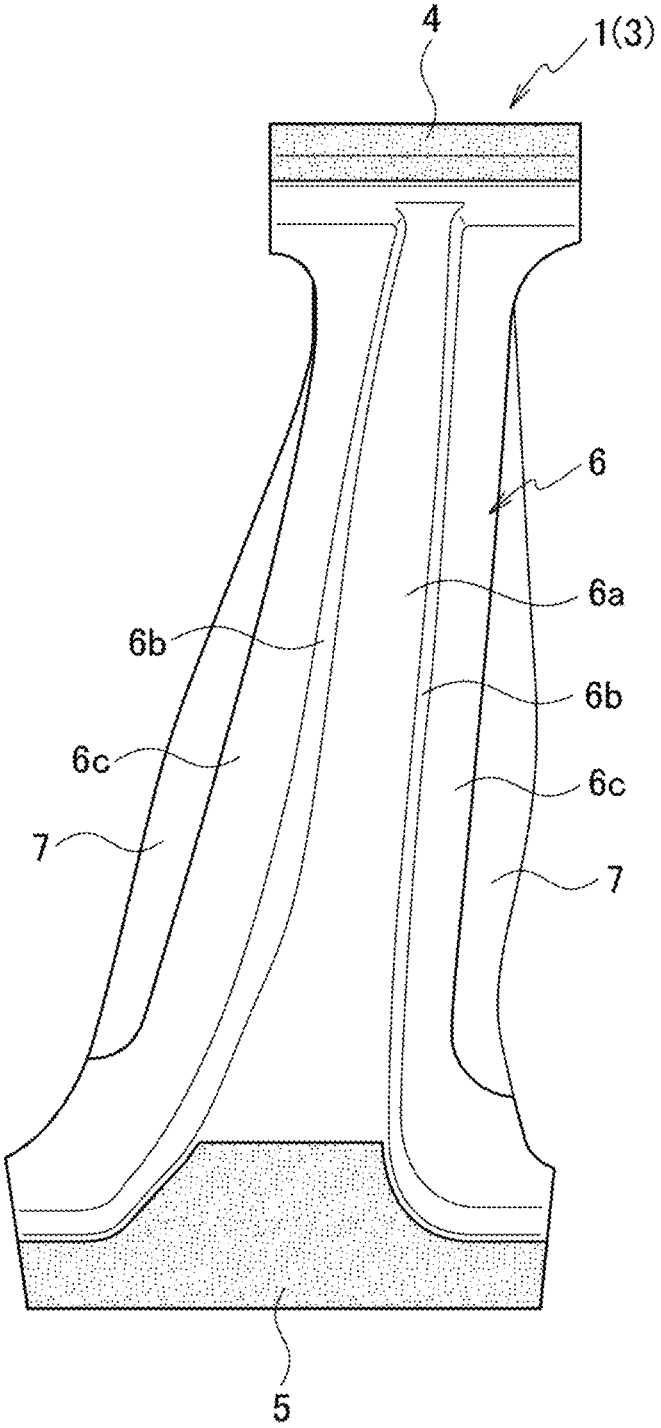
FIG. 5 is a schematic plan view of a vehicle pillar (intermediate product) manufactured by performing a method of manufacturing a vehicle pillar according to the present embodiment.

A vehicle pillar 1 shown in FIG. 5 is also referred to as a center pillar panel. The vehicle pillar 1 is a component constituting a part of a center pillar of an automobile, and is generally constituted by a high-tensile steel plate or the like.

The vehicle pillar 1 includes a upper pillar portion 4 which is coupled to a roof rail, when the vehicle pillar 1 is assembled to a vehicle body, a lower pillar portion 5 which is coupled to a side sill, when the vehicle pillar 1 is assembled to the vehicle body, and a center pillar portion 6 which connects the upper pillar portion 4 and the lower pillar portion 5, and extends in a height direction of the vehicle body. Each of the upper pillar portion 4 and the lower pillar portion 5 is formed in an approximately T-shape. The center pillar portion 6 connecting the upper pillar portion 4 and the lower pillar portion 5 is formed in a hat shape, which includes a center top plate portion 6*a*, a pair of vertical wall portions 6*b* and 6*b* connected to the center top plate portion 6*a*, and flange portions 6*c* connected to the pair of vertical wall portions 6*b* and 6*b*, respectively. When the vehicle pillar 1 is assembled to the vehicle body, the center pillar portion 6 is curved so as to be convex to the outside of the vehicle body. In accordance with this, the upper pillar portion 4 and the lower pillar portion 5 are inclined toward the inside of the vehicle body, relative to the height direction (up and down direction) of the vehicle body. It is assumed that a surplus material portion 7 disposed at a part outside a product of the vehicle pillar 1 (intermediate product 3) is cut and removed in a trimming process.

[Processing Process]

A processing process of the vehicle pillar 1 according to the present embodiment includes (i) a blanking process, (ii) a drawing process (deep drawing process), and (iii) a restriking process, a trimming process, and a piercing process. The blanking process is a pre-process for shaping a material into an appropriate shape. The drawing process is a process for processing the material into a desired shape (shape during processing). In the drawing process, since it is sometimes difficult to deep draw the material in one time, for example, when there is a large difference in the height of the vertical wall portions 6*b* of the vehicle pillar 1 of a final product shape in a longer side direction, the deep drawing process may be performed a plurality of times. Further, the drawing process is the most characteristic process in the processing process of the vehicle pillar 1 according to the present embodiment, and the details thereof will be described later. The restriking process, the trimming process, and the piercing process are post-processes for correcting the shape of the material that could not be formed in the drawing process, removing an unnecessary portion from the material processed into the desired shape, and processing a hole and the like in the material processed into the desired shape.

[Details of Forming Die]

As shown in FIGS. 1 to 4, a press forming die 10 according to the present embodiment includes a lower die 11 and an upper die 12.

Figure 6A:
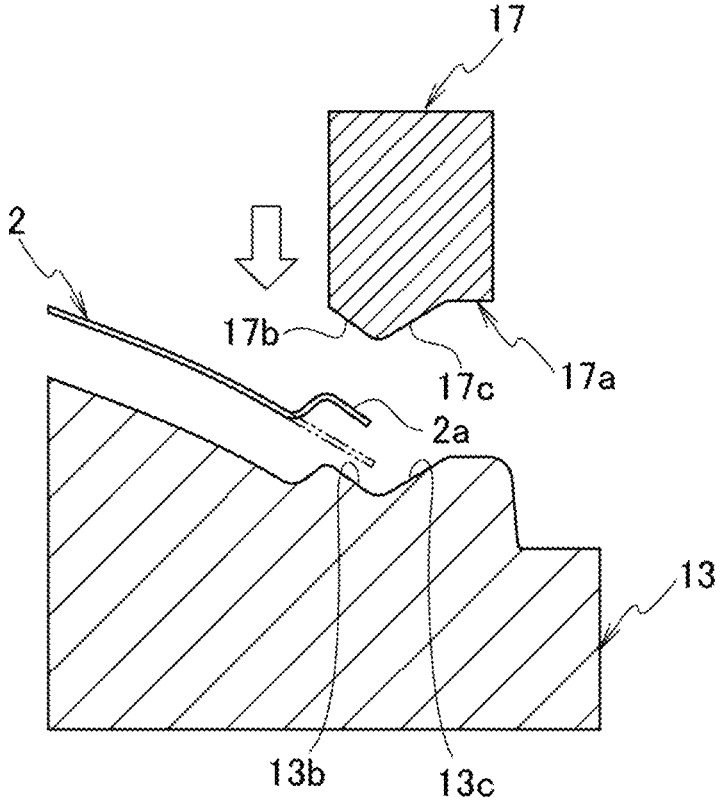
FIG. 6A is an explanatory diagram describing clamping performed by pressing pads and a punch of a lower die in the method of manufacturing a vehicle pillar according to the present embodiment.
Figure 6B:
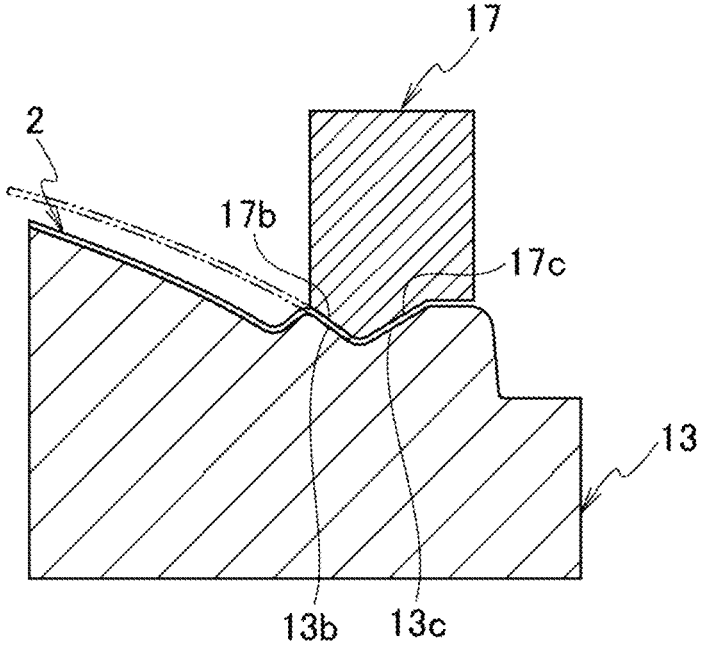
FIG. 6B is an explanatory diagram describing clamping performed by the pressing pads and the punch of the lower die in the method of manufacturing a vehicle pillar according to the present embodiment.

The lower die 11 includes a punch 13 for forming the entire shape of the vehicle pillar 1, and a pair of blank holders 14 and 14 for restraining a material to be formed (work piece 2). The punch 13 is fixed to a punch holder 15, and the pair of blank holders 14 and 14 are arranged outside the punch 13 in a shorter side direction. The pair of blank holders 14 and 14 are connected to the lower die 11 side by means of a die cushion mechanism (not shown). The pair of blank holders 14 and 14 slide in a pressing direction (up and down direction) relative to the punch 13. Both of the pair of blank holders 14 and 14 clamp the work piece 2 together with a die 16 of the upper die 12. The work piece 2 indicated by a solid line shown in FIGS. 3, 4, 6A, and 6B shows the shape after the end of press forming, and a part indicated by a two-dot chain line in FIGS. 6A and 6B shows the shape before press forming is performed.

The upper die 12 includes the die 16 which mainly faces the punch 13, and a pair of pressing pads 17 and 18. The die 16 is fixed to a die holder 19, and the pair of pressing pads 17 and 18 are arranged outside the die 16 in a longer side direction. The pair of pressing pads 17 and 18 are connected to the upper die 12 side using spring mechanisms 20 and the like. The pair of pressing pads 17 and 18 slide in a pressing direction (up and down direction) relative to the die 16. Among the pair of pressing pads 17 and 18, one pressing pad 17 (upper pressing pad) clamps one end of the work piece 2 in a longer side direction (upper pillar portion 4), together with the punch 13. Among the pair of pressing pads 17 and 18, the other pressing pad 18 (lower pressing pad) clamps the other end of the work piece 2 in the longer side direction (lower pillar portion 5), together with the punch 13.

Figure 3:
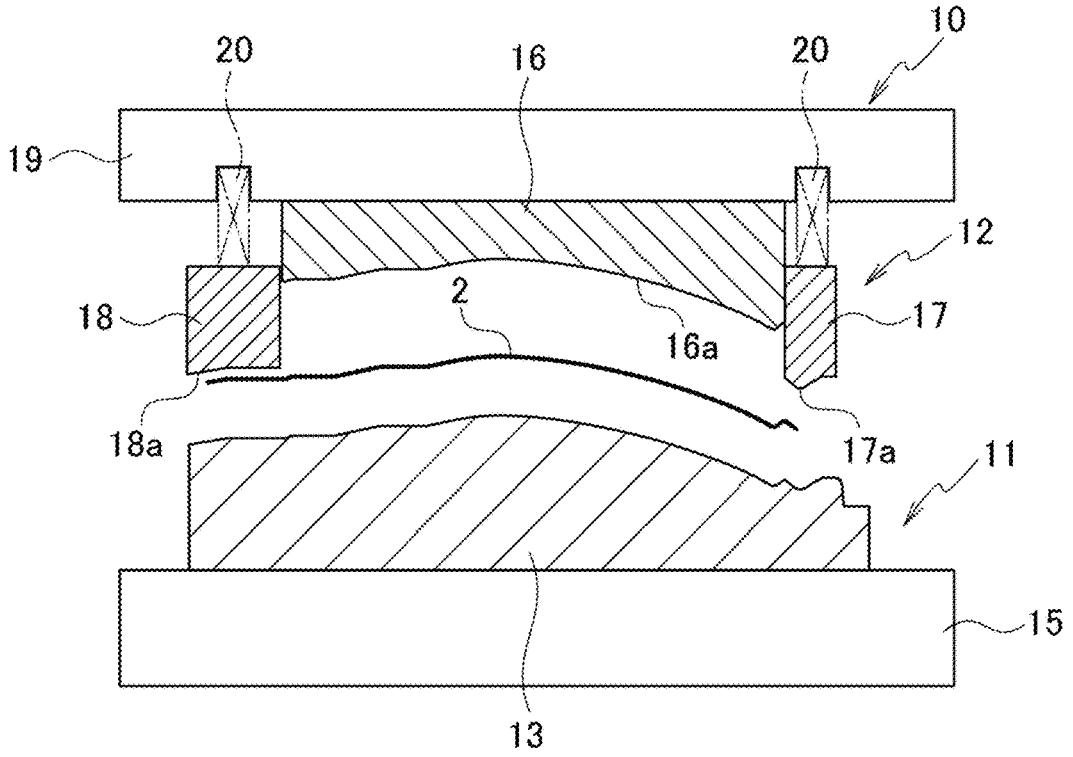
FIG. 3 is a cross-sectional view which is taken along line A-A in FIG. 1.
Figure 4:
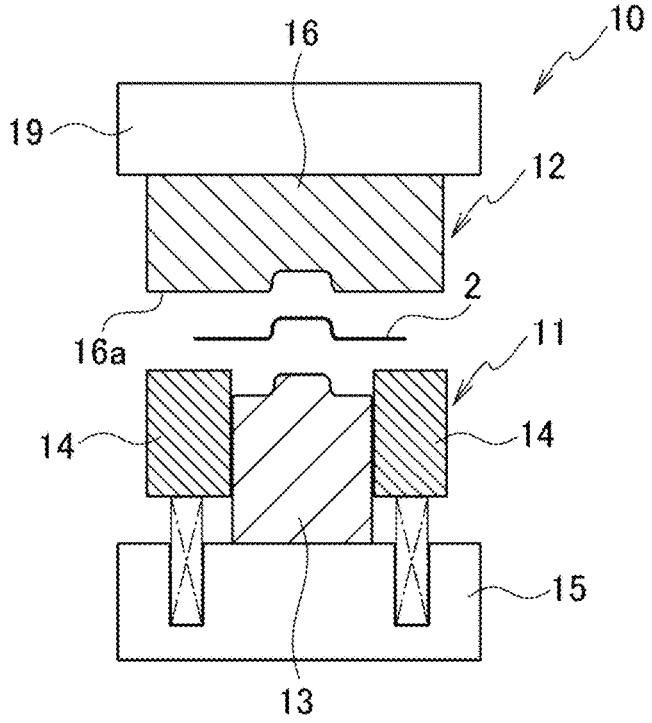
FIG. 4 is a cross-sectional view which is taken along line B-B in FIG. 1.

Before the upper die 12 is lowered, lower surfaces 17*a* and 18*a* of the pair of pressing pads 17 and 18 are located below a lower surface 16*a* of the die 16 (see FIG. 3). Therefore, during press forming, the pair of pressing pads 17 and 18 abut the work piece 2, before the die 16 abuts the work piece 2. Accordingly, the pair of pressing pads 17 and 18 can clamp the work piece 2 with the punch 13.

Incidentally, the clamping force (holding force) by the pressing pads 17 and 18 is set to be lower than the clamping force (holding force) by the blank holders 14 and 14. The clamping force (holding force) by the pressing pads 17 and 18 is set to about one-tenth of the clamping force (holding force) by the blank holders 14 and 14, for example.

As described above, the center pillar portion 6 of the vehicle pillar 1 is curved so as to be convex to the outside of the vehicle body, and in accordance with this, the upper pillar portion 4 and the lower pillar portion 5 are inclined toward the inside of the vehicle body. Therefore, at least a part of pressing surfaces (lower surfaces 17*a* and 18*a*) of the pressing pads 17 and 18 is also inclined.

In the present embodiment, an inclined surface 2*a* inclined downward relative to a horizontal direction (see FIG. 6A), is formed at a portion corresponding to the upper pillar portion 4 of the work piece 2 disposed on the lower die 11. Clamping surfaces 17*b* and 13*b* for clamping the inclined surface 2*a* are formed on the pressing pad 17 and the punch 13, respectively, and the pressing pad 17 and the punch 13 also clamp the inclined surface 2*a*. Opposing surfaces 17*c* and 13*c* are formed at outer positions in a horizontal direction of the clamping surfaces 17*b* and 13*b* formed on the pressing pad 17 and the punch 13 for clamping the inclined surface 2*a*. Both of the opposing surfaces 17*c* and 13*c* are inclined in the opposite direction (upward) to the inclined surface 2*a* relative to the horizontal direction. These opposing surfaces 17*c* and 13*c* are formed at a position where the pressing pad 17 and the punch 13 do not clamp a material. Therefore, it is assumed that the opposing surfaces 17*c* and 13*c* do not abut the work piece 2 during press forming (see FIG. 6B).

In contrast to the above, an inclined surface inclined upward relative to the horizontal direction, may be formed at the portion corresponding to the upper pillar portion 4 of the work piece 2 disposed on the lower die 11. Clamping surfaces for clamping the inclined surface may be formed on a pressing pad and a punch, respectively, and the pressing pad and the punch also clamp the inclined surface. Opposing surfaces may be formed at outer positions in a horizontal direction of the clamping surfaces formed on the pressing pad and the punch for clamping the inclined surface. Both of the opposing surfaces are inclined in the opposite direction (downward) to the inclined surface relative to the horizontal direction. The opposing surfaces are formed at a position where the pressing pad and the punch do not clamp a material. Therefore, it is assumed that the opposing surfaces do not abut the work piece during press forming.

FIG. 5 shows the intermediate product 3 of the vehicle pillar 1 after the end of press forming.

A portion corresponding to the upper pillar portion 4 of the vehicle pillar 1 is clamped between the pressing pad 17 and the punch 13 during press forming. That is, one end of the work piece 2 in the longer side direction, which is clamped between the pressing pad 17 and the punch 13 is a part of a portion to be formed as the upper pillar portion 4 of the vehicle pillar 1. In FIG. 5, a portion clamped between the pressing pad 17 and the punch 13 is shown with dot hatching.

A portion corresponding to the lower pillar portion 5 of the vehicle pillar 1 is clamped between the pressing pad 18 and the punch 13 during press forming. That is, the other end of the work piece 2 in the longer side direction, which is clamped between the pressing pad 18 and the punch 13 is a part of a portion to be formed as the lower pillar portion 5 of the vehicle pillar 1. In FIG. 5, a portion clamped between the pressing pad 18 and the punch 13 is shown with dot hatching.

A portion corresponding to the center pillar portion 6 of the vehicle pillar 1 is clamped between the die 16 and the punch 13 during press forming.

The surplus material portion 7 and a part of the flange portions 6*c* adjacent to the surplus material portion 7 are clamped between the die 16 and the blank holder 14 during press forming. The surplus material portion 7 is disposed at a part in the vicinity of the portion corresponding to the center pillar portion 6 of the vehicle pillar 1, which is outside a product.

[Details of Drawing Process]

Details of a specific drawing process will be described below.

(i) A material to be formed (work piece 2) is set on the press forming die 10 (see a two-dot chain line part of the work piece 2 shown in FIG. 6A).

(ii) A press machine starts, the upper die 12 is lowered from a top dead center, and the work piece 2 is clamped between the pair of pressing pads 17 and 18 of the upper die 12, and the punch 13 of the lower die 11, and is fixed (see a two-dot chain line part of the work piece 2 shown in FIG. 6B). A portion itself of the work piece 2 clamped between the pressing pad 17 and the punch 13 is formed in an approximately planar shape, and is not curved. Similarly, a portion itself of the work piece 2 clamped between the pressing pad 18 and the punch 13 is formed in an approximately planar shape, and is not curved. Further, as described above, when the vehicle pillar 1 is assembled to the vehicle body, the center pillar portion 6 is curved so as to be convex to the outside of the vehicle body. Therefore, the punch 13 is shaped to be convex upward, and the die 16 is shaped to be concave downward. Therefore, the work piece 2 clamped between the pair of pressing pads 17 and 18 and the punch 13 is curved, such that the work piece 2 is convex upward. The clamping performed by the pair of pressing pads 17 and 18 and the punch 13 is maintained, until the end of press forming.

(iii) When the upper die 12 is further lowered, the pair of pressing pads 17 and 18 slide relative to the die 16, and are integrated with the die 16. Due to the die 16 and an upper part of the punch 13, the work piece 2 is curved so as to be convex upward. At about the same time as the above, a center portion of the work piece 2 in a longer side direction (surplus material portion 7) is clamped between the pair of blank holders 14 and 14 and the die 16. The clamping performed by the pair of blank holders 14 and 14 and the die 16 is maintained, until the end of press forming.

(iv) When the upper die 12 is further lowered, the punch 13 of the lower die 11 enters the die 16 of the upper die 12 at a center portion of the press forming die 10, and the center pillar portion 6 having a hat shaped cross section is formed. At this time, the center pillar portion 6 is formed into a hat shape, while both ends of the work piece 2 in a shorter side direction are clamped and restrained by the blank holders 14 and 14. As in a general drawing process, the ends of the material in the shorter side direction are clamped by the blank holders 14 and 14. This can reduce the occurrence of wrinkles and springback. At the same time as this, ends of the work piece 2 in a longer side direction are clamped by the pressing pads 17 and 18. At this time, the tensile stress also acts on the ends of the work piece 2 in the longer side direction. However, since the work piece 2 is clamped by the pair of pressing pads 17 and 18, only an appropriate amount of the work piece 2 is drawn. That is, it is possible to obtain actions and effects similar to those, when press forming is performed by clamping the whole periphery of a material using a blank holder as a general press forming die.

Moreover, it is not necessary to clamp the ends of the work piece 2 in the longer side direction, with the blank holders 14 and 14. This can reduce the dimension relative to a longer side direction of a material to be formed (work piece 2), and can enhance the yield.

Incidentally, a center pillar generally has a curved shape in which a center portion thereof projects outward from a vehicle body. Therefore, the upper pillar portion 4 and the lower pillar portion 5, which have mounting surfaces to the vehicle body, are inclined inward from the vehicle body. In this case, in the press forming die 10, an inclined surface is inclined downward toward outward in the longer side direction (see FIG. 6A). Therefore, when the pressing pad 17 is pressed against the punch 13, the pressing pad 17 receives a load in a lateral direction. This may cause the sliding failure and breakage of the pressing pad 17.

Suppose that either one of the pressing pads 17 and 18 (in the present embodiment, the pressing pad 17 for clamping the upper pillar portion 4), has a surface that is inclined substantially toward outward in the longer side direction. In the above case, a pressing surface of the pressing pad 17, and a receiving surface of the punch 13 facing the pressing surface are formed into a V-shape. In other words, the pressing surface of the pressing pad 17, and the receiving surface of the punch 13 facing the pressing surface have inclined surfaces inclined in the opposite direction to inclined surfaces required for forming (opposing surfaces 17*c* and 13*c*). It is preferable that the inclined surfaces inclined in the opposite direction (opposing surfaces 17*c* and 13*c*) are set at a position where a material is not clamped.

When a material is clamped between the pressing pads 17 and 18 and the punch 13, the material may be clamped by being deformed into a V-shape.

[Action and Effect and the Like]

Actions and effects of the present embodiment will be described below.

(1) A method of manufacturing the vehicle pillar 1 according to the present embodiment is a method of manufacturing the vehicle pillar 1 including: the upper pillar portion 4 which is coupled to a roof rail, when the vehicle pillar 1 is assembled to the vehicle body; the lower pillar portion 5 which is coupled to a side sill, when the vehicle pillar 1 is assembled to the vehicle body; and the center pillar portion 6 which connects the upper pillar portion 4 and the lower pillar portion 5, and extends in the height direction of the vehicle body. The manufacturing method includes: the blanking for obtaining the work piece 2 by cutting a material; the drawing for obtaining the intermediate product 3 by forming the work piece 2, using the upper die 12 which has the die 16 and the pair of pressing pads 17 and 18, and the lower die 11 which has the punch 13 and the pair of blank holders 14 and 14; and the trimming for removing an unnecessary portion of the intermediate product 3. In the drawing, first, both ends of the work piece 2 in the longer side direction are clamped by the pressing pads 17 and 18 and the punch 13, and then both ends of the work piece 2 in the longer side direction are clamped by the blank holders 14 and 14 and the die 16. In the drawing, a center portion of the work piece 2 is clamped between the die 16 and the punch 13 to form the work piece 2, while clamping performed by the pressing pads 17 and 18 and the punch 13, and clamping performed by the blank holders 14 and 14 and the die 16 are maintained.

In the present embodiment, during press forming, first, both ends of the work piece 2 in the longer side direction are clamped between the pressing pads 17 and 18 and the punch 13. In this way, the ends of the work piece 2 in the longer side direction do not have a portion clamped between the blank holders 14 and 14. This can reduce the dimension relative to a longer side direction of a material to be formed (work piece 2), and can enhance the yield.

As described above, according to the present embodiment, it is possible to provide a method of manufacturing the vehicle pillar 1 which can enhance the yield.

(2) One end of the work piece 2 in the longer side direction, which is clamped between the pressing pad 17 and the punch 13 is a part of a portion to be formed as the upper pillar portion 4 of the vehicle pillar 1. The other end of the work piece 2 in the longer side direction, which is clamped between the pressing pad 18 and the punch 13 is a part of a portion to be formed as the lower pillar portion 5 of the vehicle pillar 1.

In the present embodiment, a portion of the work piece 2 which is clamped between the pressing pads 17 and 18 and the punch 13 is not a portion outside a product. Therefore, it is not necessary to dispose surplus material portions at both ends of the work piece 2 in the longer side direction, and it is possible to enhance the yield.

(3) Either one of the ends of the work piece 2 disposed on the lower die 11 in the longer side direction, has the inclined surface 2*a* which is inclined downward or upward relative to the horizontal direction. The clamping surfaces 17*b* and 13*b* for clamping the inclined surface 2*a* are formed on the pressing pad 17 and the punch 13, respectively, and the pressing pad 17 and the punch 13 also clamp the inclined surface 2*a*. The opposing surfaces 17*c* and 13*c* are formed at outer positions in the horizontal direction of the clamping surfaces 17*b* and 13*b* formed on the pressing pad 17 and the punch 13 for clamping the inclined surface 2*a*. Both of the opposing surfaces 17*c* and 13*c* are inclined in the opposite direction to the inclined surface 2*a* relative to the horizontal direction.

A center pillar generally has a curved shape in which a center portion thereof projects outward from the vehicle body. Therefore, the upper pillar portion 4 and the lower pillar portion 5, which have mounting surfaces to the vehicle body, are inclined inward from the vehicle body. In this case, in the press forming die 10, an inclined surface is inclined downward toward outward in the longer side direction (see FIG. 6A). Therefore, when the pressing pad 17 is pressed against the punch 13, the pressing pad 17 receives a load in the lateral direction. This may cause the sliding failure and breakage of the pressing pad 17.

Therefore, in the present embodiment, the upper pressing pad (pressing pad 17) and the punch 13, which clamp the inclined surface 2*a*, have the clamping surfaces 17*b* and 13*b*, and the opposing surfaces 17*c* and 13*c*. A pressing surface of the pressing pad 17, and a receiving surface of the punch 13 facing the pressing surface are formed into a V-shape. A load facing the load of the pressing pad 17 in the lateral direction is generated to maintain balance.

(4) The press forming die 10 according to the present embodiment is used to press form the work piece 2, and is the press forming die 10 for manufacturing the vehicle pillar 1 including: the upper pillar portion 4 which is coupled to a roof rail, when the vehicle pillar 1 is assembled to the vehicle body; the lower pillar portion 5 which is coupled to a side sill, when the vehicle pillar 1 is assembled to the vehicle body; and the center pillar portion 6 which connects the upper pillar portion 4 and the lower pillar portion 5, and extends in the height direction of the vehicle body. The press forming die 10 includes the upper die 12 which has the die 16 and the pair of pressing pads 17 and 18, and the lower die 11 which has the punch 13 and the pair of blank holders 14 and 14. The upper die 12 and the lower die 11 are configured such that, both ends of the work piece 2 in the longer side direction are clamped between the pressing pads 17 and 18 and the punch 13, before the center portion of the work piece 2 is clamped between the die 16 and the punch 13 to form the work piece 2.

In the present embodiment, during press forming, first, both ends of the work piece 2 in the longer side direction are clamped between the pressing pads 17 and 18 and the punch 13. In this way, the ends of the work piece 2 in the longer side direction do not have a portion clamped between the blank holders 14 and 14. This can reduce the dimension relative to a longer side direction of a material to be formed (work piece 2), and can enhance the yield.

As described above, according to the present embodiment, it is possible to provide the press forming die 10 which can enhance the yield.

(5) One end of the work piece 2 in the longer side direction, which is clamped between the pressing pad 17 and the punch 13 is a part of a portion to be formed as the upper pillar portion 4 of the vehicle pillar 1. The other end of the work piece 2 in the longer side direction, which is clamped between the pressing pad 18 and the punch 13 is a part of a portion to be formed as the lower pillar portion 5 of the vehicle pillar 1.

In the present embodiment, a portion of the work piece 2 which is clamped between the pressing pads 17 and 18 and the punch 13 is not a portion outside a product. Therefore, it is not necessary to dispose surplus material portions at both ends of the work piece 2 in the longer side direction, and it is possible to enhance the yield.

(6) Either one of the ends of the work piece 2 disposed on the lower die 11 in the longer side direction, has the inclined surface 2*a* which is inclined downward or upward relative to the horizontal direction. The clamping surfaces 17*b* and 13*b* for clamping the inclined surface 2*a* are formed on the pressing pad 17 and the punch 13, respectively, and the pressing pad 17 and the punch 13 also clamp the inclined surface 2*a*. The opposing surfaces 17*c* and 13*c* are formed at outer positions in the horizontal direction of the clamping surfaces 17*b* and 13*b* formed on the pressing pad 17 and the punch 13 for clamping the inclined surface 2*a*. Both of the opposing surfaces 17*c* and 13*c* are inclined in the opposite direction to the inclined surface 2*a* relative to the horizontal direction.

A center pillar generally has a curved shape in which a center portion thereof projects outward from the vehicle body. Therefore, the upper pillar portion 4 and the lower pillar portion 5, which have mounting surfaces to the vehicle body, are inclined inward from the vehicle body. In this case, in the press forming die 10, an inclined surface is inclined downward toward outward in the longer side direction (see FIG. 6A). Therefore, when the pressing pad 17 is pressed against the punch 13, the pressing pad 17 receives a load in the lateral direction. This may cause the sliding failure and breakage of the pressing pad 17.

Therefore, in the present embodiment, the upper pressing pad (pressing pad 17) and the punch 13, which clamp the inclined surface 2*a*, have the clamping surfaces 17*b* and 13*b*, and the opposing surfaces 17*c* and 13*c*. A pressing surface of the pressing pad 17, and a receiving surface of the punch 13 facing the pressing surface are formed into a V-shape. A load facing the load of the pressing pad 17 in the lateral direction is generated to maintain balance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A method of manufacturing a vehicle pillar including: an upper pillar portion that is coupled to a roof rail, when the vehicle pillar is assembled to a vehicle body; a lower pillar portion that is coupled to a side sill, when the vehicle pillar is assembled to the vehicle body; and a center pillar portion that connects the upper pillar portion and the lower pillar portion, and extends in a height direction of the vehicle body, the method comprising:

a blanking for obtaining a work piece by cutting a material;

a drawing for obtaining an intermediate product by forming the work piece, using an upper die that includes a die and a pair of pressing pads, and a lower die that includes a punch and a pair of blank holders; and a trimming for removing an unnecessary portion of the intermediate product; wherein in the drawing, both ends of the work piece in a longer side direction are clamped between the pressing pads and the punch, then, both ends of the work piece in a shorter side direction are clamped between the blank holders and the die, and a center portion of the work piece is clamped between the die and the punch to form the work piece, while the clamping performed by the pressing pads and the punch, and the clamping performed by the blank holders and the die are maintained.

2. The method of manufacturing a vehicle pillar according to claim 1, wherein one of the ends of the work piece in the longer side direction, that is clamped between the pressing pads and the punch is a part of a portion to be formed as the upper pillar portion of the vehicle pillar, and the other of the ends of the work piece in the longer side direction, that is clamped between the pressing pads and the punch is a part of a portion to be formed as the lower pillar portion of the vehicle pillar.

3. The method of manufacturing a vehicle pillar according to claim 1, wherein either one of the ends of the work piece disposed on the lower die in the longer side direction, includes an inclined surface that is inclined downward or upward relative to a horizontal direction, clamping surfaces for clamping the inclined surface are formed on the pressing pads and the punch that clamp the inclined surface, and opposing surfaces are formed at outer positions in the horizontal direction of the clamping surfaces formed on the pressing pads and the punch that clamp the inclined surface, the opposing surfaces being inclined in an opposite direction to the inclined surface relative to the horizontal direction.

* * * * *